US005539302A

United States Patent [19]

Takimoto et al.

[11] Patent Number: 5,539,302

[45] Date of Patent: Jul. 23, 1996

[54] REFERENCE POWER SUPPLY

[75] Inventors: Kyuichi Takimoto; Kazuyoshi Arimura, both of Kasugai, Japan

[73] Assignees: Fujitsu Limited, Kawasaki; Fujitsu VLSI Limited, Kasugai, both of Japan

[21] Appl. No.: 322,509

[22] Filed: Oct. 14, 1994

[30] Foreign Application Priority Data

Oct. 14, 1993 [JP] Japan ..... 5-257279

[51] Int. Cl.[6] ..... G05F 3/16

[52] U.S. Cl. ..... 323/315; 323/317

[58] Field of Search ..... 323/313, 314, 323/315, 316, 317

[56] References Cited

U.S. PATENT DOCUMENTS 4,935,690 6/1990 Yan ..... 323/314

5,410,241 4/1995 Cecil ..... 323/315

*Primary Examiner*—Peter S. Wong

*Assistant Examiner*—Shawn Riley

*Attorney, Agent, or Firm*—Nikaido, Marmelstein, Murray & Oram

[57] ABSTRACT

A reference power supply includes an amplifier having an output terminal and a reference voltage source for providing the amplifier with a constant voltage. The amplifier amplifies the constant voltage to produce a load-driving reference voltage at the output terminal. The amplifier includes first and second constant current sources and a first transistor as an output transistor having an emitter connected to a high-potential power supply, a collector connected to the output terminal and a base connected to the second constant current source. A resistor circuit is provided between the collector of the first transistor and the low-potential power supply. The amplifier also includes first, second and third current mirror circuits. The first current mirror circuit has second and third transistors. The second transistor has an emitter connected to the resistor circuit and the third transistor has an emitter connected to the reference voltage source. The second current mirror circuit has a fourth transistor connected to the first constant current source and a fifth transistor connected to the second transistor. The third current mirror circuit has a sixth transistor connected to the third transistor, and a seventh transistor T7 connected to the second constant current source.

9 Claims, 4 Drawing Sheets

REFERENCE POWER SUPPLY

BACKGROUND OF THE INVENTION

1. Field of the Invention

The present invention relates to a reference power supply which supplies a reference voltage to a load connected to the reference power supply.

2. Description of the Related Art

Electronic devices, such as portable telephones, incorporate a reference power supply which generates a reference voltage based on the voltage supplied from an external power supply. With the ever increasing trend to miniaturize such products, there is an accompanying demand for power supplies capable of delivering a lower reference voltage supply.

FIG. 1 illustrates a conventional reference power supply frequently found in electronic devices. The reference power supply comprises a reference voltage source 21 and an amplifier 22. The reference voltage source 21, formed from a bandgap reference circuit, supplies a given voltage $V_{IN}$ to the non-inverting input terminal of the amplifier 22. Based on the input voltage $V_{IN}$, the amplifier 22 produces a reference voltage $V_{REF}$ supplied to a load (not shown). The reference voltage $V_{REF}$ is feed back to the inverting input terminal of the amplifier 22 via an external circuit consisting of resistors R11 and R12. That is, the amplifier 22 is a non-inverting amplifier circuit. Consequently, the non-inverting and inverting input terminals of the amplifier are considered to form an imaginary short-circuit, and therefore, share the same voltage potential. As a result, the voltage fed back to the inverting input terminal is obtained by dividing the reference voltage $V_{REF}$ by the resistors R11 and R12.

FIG. 2 shows the detailed structure of the amplifier 22. PNP transistors Q21 and Q22 have their emitters connected together to form a differential circuit. PNP transistors Q23, Q24 and Q29 have emitters connected to a power supply $V_{CC}$, and bases connected together. Those transistors Q23, Q24 and Q29 forms current mirror circuits. The collector of the transistor Q23 is grounded via a constant current circuit 24. The transistor Q24 has a collector connected to the emitters of the transistors Q21 and Q22, allowing current to flow through the transistors Q21 and Q22 via their emitters.

NPN transistors Q25 and Q26 have bases connected together to form a current mirror circuit. The collector of the transistor Q25 is connected to the collector of the transistor Q21. The transistor Q26 has a collector connected to its own base and to the collector of the transistor Q22. NPN transistors Q27 and Q28 are connected in such a way as to form a Darlington circuit. The base of the transistor Q27 is connected to the collector of the transistor Q25. The transistor Q29 has a collector connected to an output terminal 23, with the resistors R12 and R11 connected in series being between the output terminal 23 and the ground.

The transistor Q29 supplies currents to the transistor Q27 and the resistor R12. The collector current of the transistor Q29 is supplied via the output terminal 23 to the load in order to drive the load. The level of the load driving current of the transistor Q29 is determined by the ratio of the emitter area of the transistor Q29 to that of the transistor Q23. The base of the transistor Q22 is connected to a node between the resistors R11 and R12. The emitters of the transistors Q25, Q26 and Q28 and one end of the resistor R11 are grounded.

In the conventional amplifier 22, the load driving current should be generated by the current mirror circuit composed of the transistors Q23 and Q29. This requires that the current mirror ratio (i.e., the ratio of the emitter area of the transistor Q29 to that of the transistor Q23) be set sufficiently large, and that the transistor Q29 have a large emitter area. The greater the current mirror ratio is set, the greater the base current of the transistor Q29 becomes. If the current mirror ratio is set too large, however, the desired current level will not flow through the transistor Q29.

This shortcoming can be overcome by a reference power supply circuit as shown in FIG. 3. This reference power supply has a reference voltage source 21 and an amplifier 25 having an additional NPN transistor Q30. The NPN transistor Q30 has a collector connected to a power supply $V_{CC}$, an emitter connected to the output terminal 23, and a base connected to the collector of the transistor Q29. The transistor Q30 produces the load driving current in accordance with the base current supplied from the transistor Q29. This circuit structure reduces the necessity to increase the emitter area of the transistor Q29, and thus allows for the use of a smaller current mirror ratio.

Given that $V_{BE}$ is the voltage between the base and emitter of the transistor Q30 and that $V_{CE}$ is the voltage between the collector and emitter of the transistor Q29, the minimum voltage $V_{CCMIN}$ of the power supply $V_{CC}$ that can be used in the amplifier 25 satisfies the following equation.

$$V_{CCMIN}=V_{REF}+V_{BE}+V_{CE}$$

In other words, the voltage of the power supply $V_{CC}$ cannot be set lower than this minimum voltage. Thus, for example, with the reference voltage $V_{REF}$ set to 1.8 V, the base-emitter voltage $V_{BE}$ set to 0.7 V and the collector-emitter voltage $V_{CE}$ set to 0.1 V, the voltage of the power supply $V_{CC}$ should be set equal to or greater than 2.6 V.

SUMMARY OF THE INVENTION

Accordingly, it is a primary objective of the present invention to provide a reference power supply adapted for use as an external low-voltage power supply and having an improved load driving performance.

To achieve the foregoing and other objects and in accordance with the purpose of the present invention, an improved reference power supply is provided.

As shown in FIG. 4, the reference power supply according to the present invention is supplied with power from a high-potential power supply $V_{CC}$ and a low-potential power supply $V_{SS}$, and comprises a reference voltage source and an amplifier coupled to the reference voltage source. The reference voltage source produces a constant voltage based on power from the high-potential and low-potential power supplies. The amplifier has an output terminal connectable to an external load, and amplifies the constant voltage to produce a load-driving reference voltage $V_{REF}$ at the output terminal. The amplifier includes a first and second constant current sources CCS1 and CCS2, which are connected to the high-potential power supply $V_{CC}$, and a transistor T1 as an output transistor. The transistor T1 has an emitter connected to the high-potential power supply $V_{CC}$, a collector connected to the output terminal and a base connected to the second constant current source CCS2. A resistor circuit is provided between the collector of the transistor T1 and the low-potential power supply $V_{SS}$.

The amplifier further includes first, second and third current mirror circuits. The first current mirror circuit incorporates transistors T2 and T3. The transistor T2 has an emitter connected to the resistor circuit while the transistor T3 has an emitter connected to the reference voltage source. The second current mirror circuit incorporates a transistor T4 between the first constant current source CCS1 and the low-potential power supply $V_{SS}$, and a transistor T5 between the transistor T2 and the low-potential power supply $V_{SS}$. The third current mirror circuit incorporates a transistor T6 between the transistor T3 and the low-potential power supply $V_{SS}$, and a transistor T7 between the second constant current source CCS2 and the low-potential power supply $V_{SS}$.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENT

Figure 5:
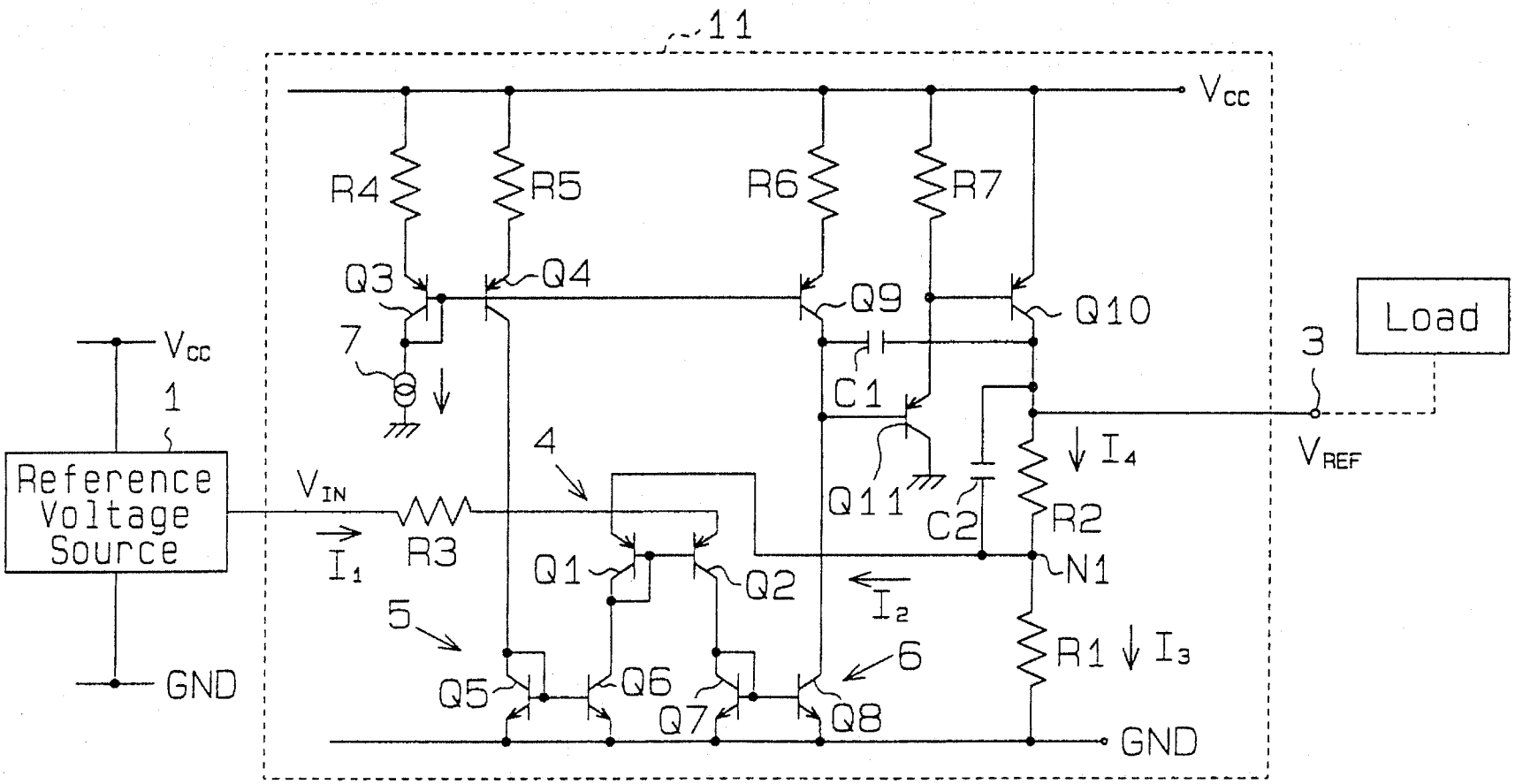
FIG. 5 is a circuit diagram showing a reference power supply circuit according to an embodiment of this invention.

A reference power supply according to an embodiment of the present invention will now be described with reference to FIG. 5. The reference power supply comprises a reference voltage source 1 and an amplifier 11. The reference voltage source 1, which may be formed using a bandgap reference circuit, applies a constant voltage $V_{IN}$ to the amplifier 11 based on the voltages from a high-potential power supply $V_{CC}$ and ground GND as a low-potential power supply, without being affected by variations in ambient temperature and the level of the supply voltage.

The details of the amplifier 11 will be discussed below. A PNP transistor Q1 has an emitter connected to a node N1 between resistors R1 and R2, a base connected to the base of a PNP transistor Q2 and a collector connected to the collector of an NPN transistor Q6. The base and collector of the transistor Q1 are connected together. The PNP transistor Q2 further has an emitter connected to a reference voltage source 1 via a resistor R3 and a collector connected to the collector of an NPN transistor Q7. The PNP transistors Q1 and Q2 form a first current mirror circuit 4. The resistor R3 is provided for offset compensation, and compensates for changes in the voltage level at the node N1 caused by the current flowing through the transistor Q1 via the resistor R2.

The emitters of PNP transistors Q3, Q4 and Q9, as constant current sources, are connected via resistors R4, R5 and R6 to the power supply $V_{CC}$. The PNP transistors Q3, Q4 and Q9 have their bases connected together to from another current mirror circuit. The collector of the transistor Q3 is grounded via a constant current circuit 7.

An NPN transistor Q5 has its collector and base connected to the base of an NPN transistor Q6. The transistors Q5 and Q6 form a second current mirror circuit 5. The transistor Q6 receives the current from the collector of the transistor Q1. Since the transistor Q4 has its collector connected to the collector of the transistor Q5, the transistor Q4 supplies a current to the transistor Q5.

The collector and base of the NPN transistor Q7 are connected to the base of an NPN transistor Q8, so that the transistors Q7 and Q8 form a third current mirror circuit 6. Since the transistor Q7 has its collector connected to the collector of the transistor Q2, the transistor Q7 receives the current from the collector of the transistor Q2. Since the transistor Q9 has its collector connected to the collector of the transistor Q8, the transistor Q9 supplies a current to the transistor Q8.

A PNP transistor Q10 has an emitter connected to the power supply $V_{CC}$ and a collector connected to the resistor R2 and to an output terminal 3. The transistor Q10 supplies a load driving current to a load via the output terminal 3.

A PNP transistor Q11 has a base connected to the collector of the transistor Q9, an emitter connected to the base of the transistor Q10 and a collector grounded. As a result, the transistors Q10 and Q11 form a Darlington circuit, in which the base current of the transistor Q11 is $1/h_{FE}$ times as large as that of the transistor Q10, where $h_{FE}$ denotes the current amplification factor of the transistor Q11. The emitter of the transistor Q11 is connected to the power supply $V_{CC}$ via a resistor R7. When a leak current flows through the transistor Q11, the resistor R7 prevents the transistor Q10 from malfunctioning.

A capacitor C1 is connected between the collector of the transistor Q10 and the base of the transistor Q11. A capacitor C2 is connected between the collector of the transistor Q10 and the emitter of the transistor Q1. The capacitors C1 and C2 are provided for phase compensation and prevent the oscillation of a reference voltage $V_{REF}$ at the output terminal 3.

The operation of this reference power supply will be described below. When the output voltage $V_{IN}$ of the reference voltage source 1 is applied to the emitter of the transistor Q2 via the resistor R3, a current $I_1$ flows through the emitter of the transistor Q2. The emitter of the transistor Q2 has a voltage level obtained by subtracting a voltage drop ($I_1 \times R3$) across the resistor R3 from the output voltage $V_{IN}$. Accordingly, the bases of the transistors Q1 and Q2 have a voltage level obtained by subtracting the base-emitter voltage $V_{BE}$ of the transistor Q2 from the emitter voltage of the transistor Q2.

A voltage higher than the base voltage of the transistor Q1 by the base-emitter voltage $V_{BE}$ is applied to the node N1 between the resistors R1 and R2. That is, the voltage value at the node N1 equals to the value of the emitter voltage of the transistor Q2. This voltage is divided by the resistors R1 and R2, and the reference voltage $V_{REF}$ according to the divided voltage appears at the output terminal 3.

Let us denote that $I_1$ is the current flowing across the resistor R3, $I_2$ is the emitter current of the transistor Q1, and $I_3$ is the current flowing across the resistor R1. As the transistors Q1 and Q2 form the current mirror circuit 4, the current $I_1$ is equal in level to the current $I_2$. Therefore, the following equations (1) and (2) are satisfied.

$$I_1 = I_2 \tag{1}$$

$$I_3 = \frac{V_{IN} - I_1 \cdot R3}{R1} = \frac{V_{IN} - I_2 \cdot R3}{R1} \tag{2}$$

From the equations (1) and (2), the reference voltage $V_{REF}$ is expressed as follows:

$$V_{REF} = V_{IN} - I_1 \cdot R3 + (I_2 + I_3)R2$$
$$= V_{IN} - I_2 \cdot R3 + I_2 \cdot R2 + \frac{R2(V_{IN} - I_2 \cdot R3)}{R1}$$
$$= \frac{R1 + R2}{R1} \cdot (V_{IN} - I_2 \cdot R3) + I_2 \cdot R2$$

Figure 1:
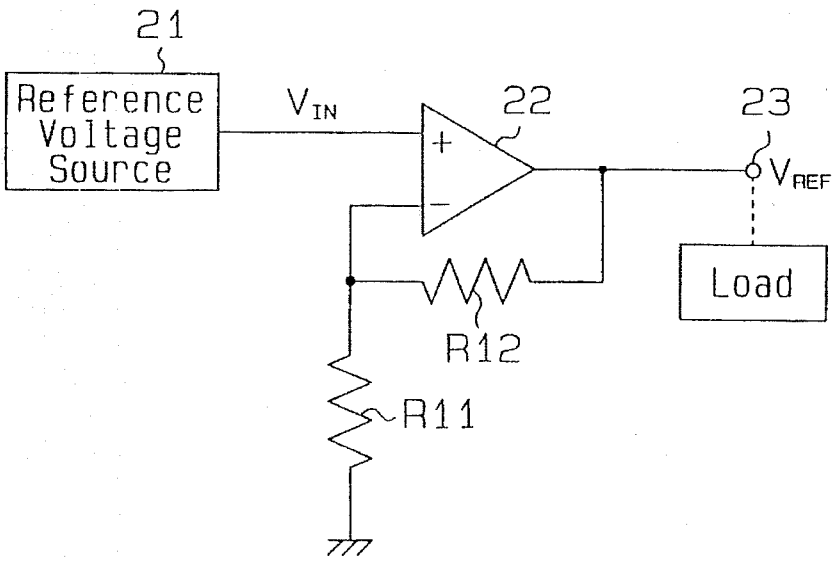
Fig. 1 (PRIOR ART)
FIG. 1 is a schematic circuit diagram of a conventional reference power supply.
Figure 2:
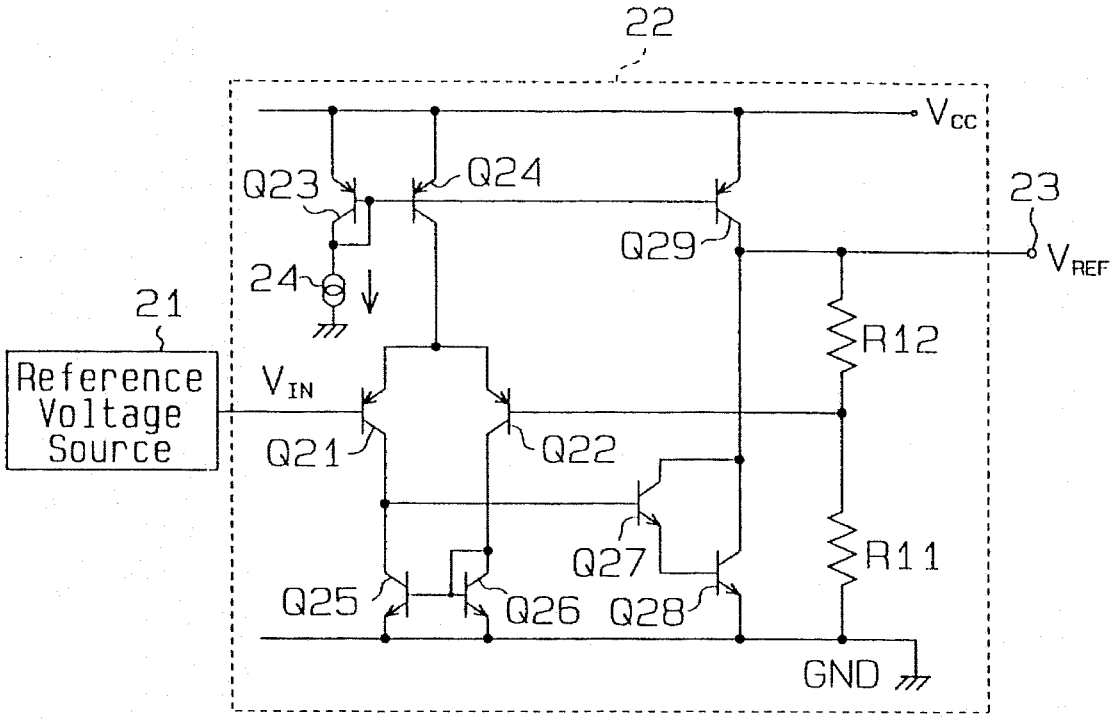
Fig. 2 (PRIOR ART)
FIG. 2 is a circuit diagram showing the detailed structure of an amplifier shown in FIG. 1.
Figure 3:
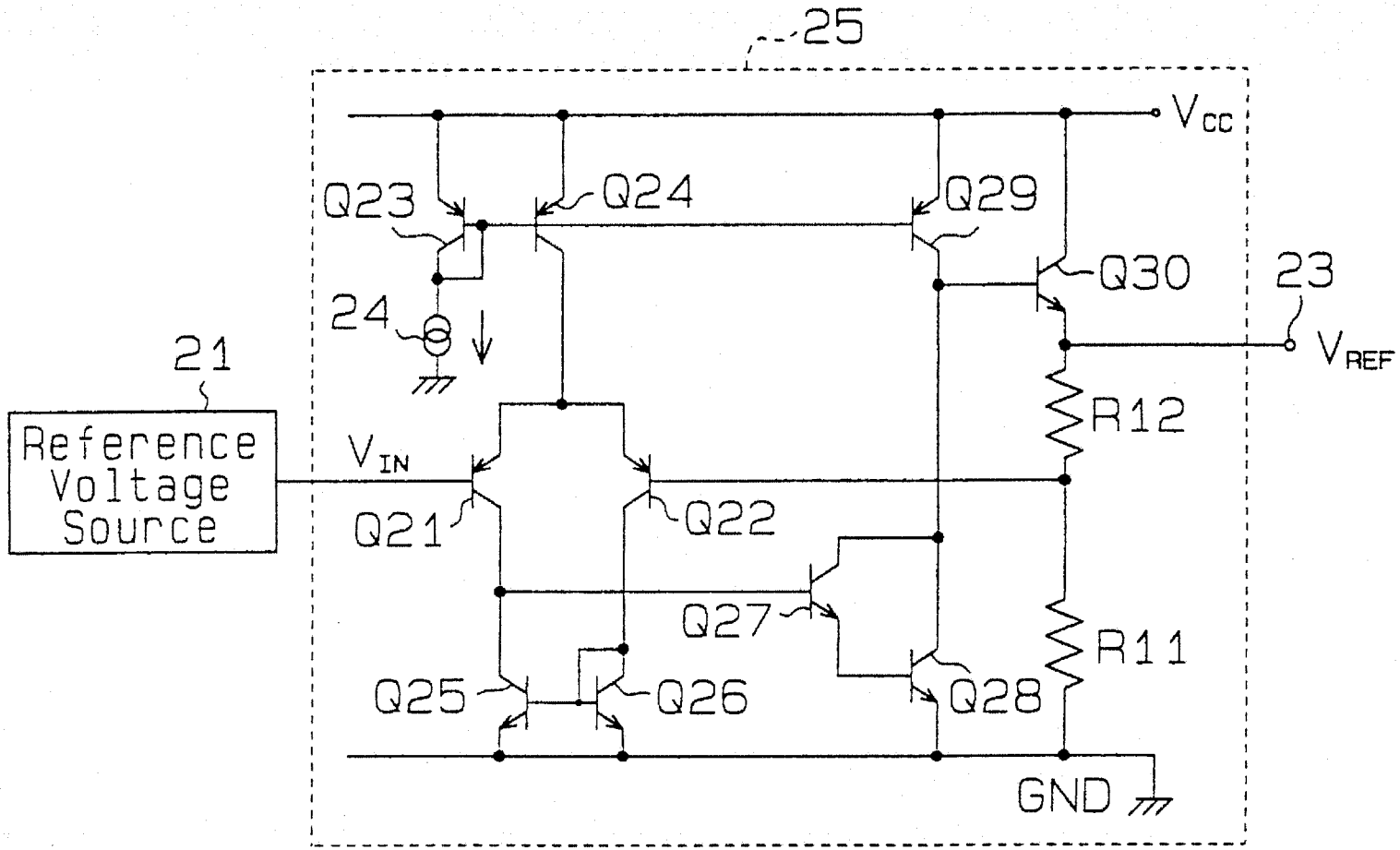
Fig. 3 (PRIOR ART)
FIG. 3 is a circuit diagram showing an another conventional reference power supply circuit having an improved amplifier.
Figure 4:
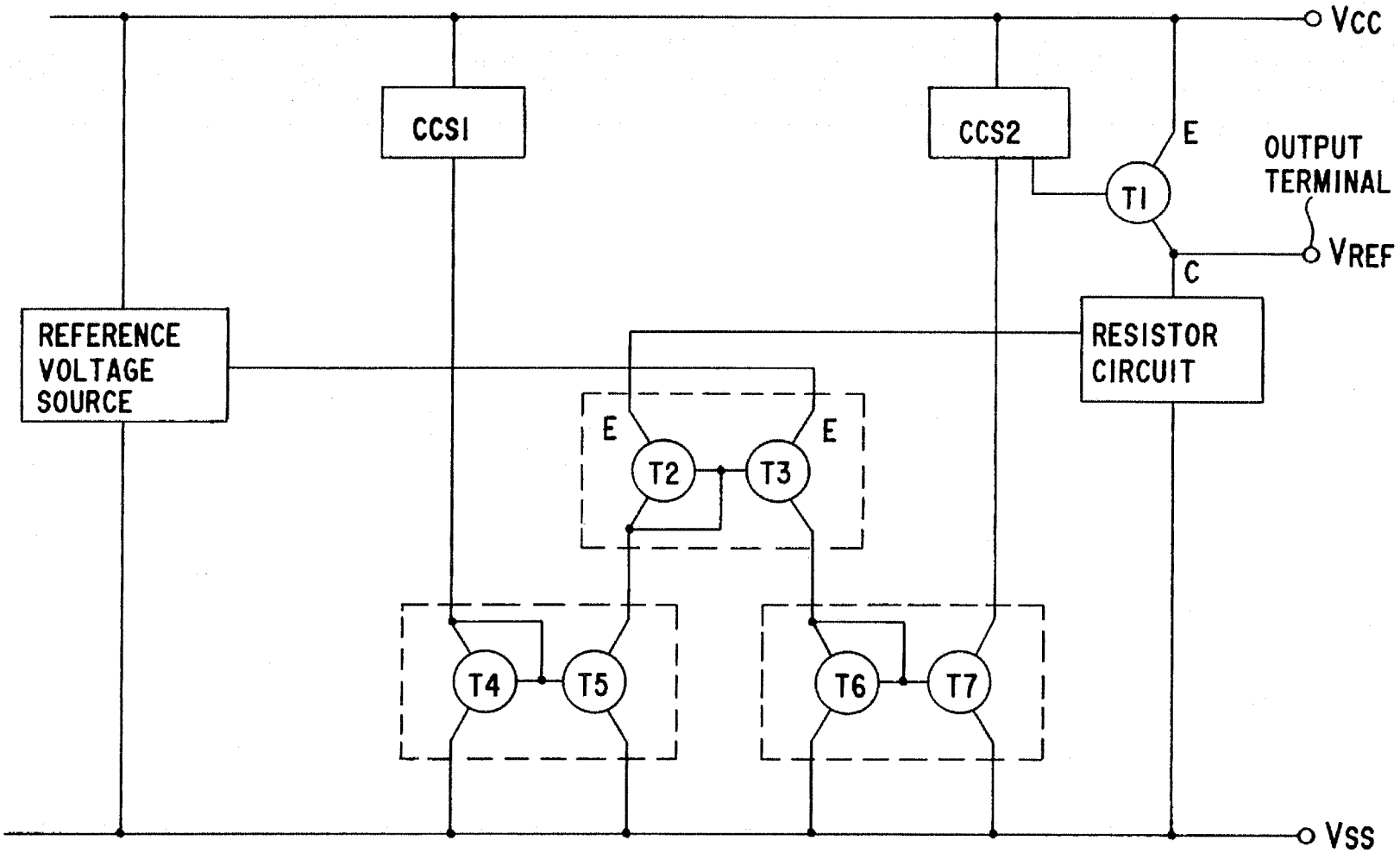
FIG. 4 is a schematic illustration showing essential parts of the present invention.

In the reference power supply of this embodiment, the output transistor Q10 of the amplifier 11 is a PNP transistor. Therefore, the minimum value of the voltage from the power supply $V_{CC}$ on which the amplifier 11 can operate is the sum of the reference voltage $V_{REF}$ and the collector-emitter voltage $V_{CE}$ of the output transistor Q10. This allows the reference power supply to be used as a reduced voltage supply. Given that the reference voltage $V_{REF}$ is 1.8 V and the collector-emitter voltage $V_{CE}$ of the output transistor Q10 is 0.1 V, for instance, the voltage of the power supply $V_{CC}$ need only be set to equal to or higher than 1.9 V. This is lower than the minimum value of the operational voltage of the amplifier 25 in the conventional reference power supply shown in FIG. 3 by the base-emitter voltage $V_{BE}$ Of the transistor Q30.

The output transistor Q10 has a common emitter configuration or emitter-grounded configuration with respect to the power supply $V_{CC}$. That is, the collector of the output transistor Q10 is connected to the output terminal 3. Generally, the emitter-grounded transistor Q10 can permit the reference voltage $V_{REF}$ at the output terminal to come closer to the supply voltage $V_{CC}$ as compared with the emitter-follower type output transistor Q30 shown in FIG. 3. The reference power supply according to this embodiment allows for improved driving load performance compared with the conventional reference power supply shown in FIG. 3.

Further, the Darlington circuit formed by the transistors Q10 and Q11 amplifies the transistor Q11's base current (i.e., the collector current of the transistor Q9) to obtain the amplified collector current of the transistor Q10 (i.e., current $I_4$). Accordingly, it is unnecessary to set the emitter area of the transistor Q9 much larger than the emitter area of the transistor Q3, in order for the current to match the current mirror ratio and to flow through the current mirror circuit consisting of the transistors Q3 and Q9.

Although only one embodiment of the present invention has been described herein, it should be apparent to those skilled in the art that the present invention may be embodied in many other specific forms without departing from the spirit or scope of the invention. Particularly, it should be understood that the following modifications may be employed.

The current mirror circuits 5 and 6 in the above embodiment may each be constituted of N type MOS transistors. Further, the PNP transistors Q3, Q4 and Q9 in the above embodiment may be replaced with P type MOS transistors to constitute current mirror circuits.

Therefore, the present examples and embodiment are to be considered as illustrative and not restrictive and the invention is not to be limited to the details given herein, but may be modified within the scope of the appended claims.

What is claimed is:

1. A reference power supply, supplied with power from a high-potential power supply and a low-potential power supply, comprising:

a reference voltage source for producing a constant voltage based on power from said high-potential and low-potential power supplies; and an amplifier, coupled to said reference voltage source and having an output terminal connectable to an external load, for amplifying said constant voltage to produce a load-driving reference voltage at said output terminal, wherein said amplifier includes:

first and second constant current sources connected to said high-potential power supply;

a first transistor having an emitter connected to said high-potential power supply, a collector connected to said output terminal and a base connected to said second constant current source, said first transistor serving as an output transistor;

a first resistor circuit provided between the collector of said first transistor and said low-potential power supply;

a first current mirror circuit having second and third transistors, said second transistor having an emitter connected to said first resistor circuit, said third transistor having an emitter connected to said reference voltage source;

a second current mirror circuit having a fourth transistor, provided between said first constant current source and said low-potential power supply, and a fifth transistor, provided between said second transistor and said low-potential power supply; and a third current mirror circuit having a sixth transistor, provided between said third transistor and said low-potential power supply, and a seventh transistor, provided between said second constant current source and said low-potential power supply.

2. The reference power supply according to claim 1 further comprising a second resistor circuit provided between said reference voltage source and said third transistor.

3. The reference power supply according to claim 1, wherein said first resistor circuit has first and second resistors connected in series, and wherein the emitter of said second transistor is connected to a node between said first and second resistors.

4. The reference power supply according to claim 1, wherein said amplifier further includes an eighth transistor having a base connected to said second constant current source, an emitter connected to said base of said first transistor and a collector connected to said low-potential power supply, wherein said first and eighth transistors form a Darlington circuit.

5. The reference power supply according to claim 4, wherein a third resistor connects the emitter of said eighth transistor to said high-potential power supply.

6. The reference power supply according to claim 4, wherein a fourth and fifth resistors respectively connect said first and second constant current sources to said high-potential power supply.

7. A reference power supply, supplied with power from a high-potential power supply and a low-potential power supply, comprising:

a reference voltage source for producing a constant voltage based on power from said high-potential and low-potential power supplies; and an amplifier, coupled to said reference voltage source and having an output terminal connectable to an external load for amplifying said constant voltage to produce a load-driving reference voltage at said output terminal, wherein said amplifier includes:

first and second constant current sources connected to said high-potential power supply;

a first transistor having an emitter connected to said high-potential power supply, a collector connected to said output terminal and a base connected to said second constant current source, said first transistor serving as an output transistor;

a first resistor circuit provided between the collector of said first transistor and said low-potential power supply;

a first current mirror circuit having second and third transistors, said second transistor having an emitter connected to said first resistor circuit, said third transistor having an emitter connected to said reference voltage source;

a second current mirror circuit having a fourth transistor, provided between said first constant current source and said low-potential power supply, and a fifth transistor, provided between said second transistor and said low-potential power supply; and a third current mirror circuit having a sixth transistor, provided between said third transistor and said low-potential power supply, and a seventh transistor, provided between said second constant current source and said low-potential power supply;

said amplifier further including an eighth transistor having a base connected to said second constant current source, an emitter connected to said base of said first transistor and a collector connected to said low-potential power supply, wherein said first and eighth transistors form a Darlington circuit; and a first capacitor connected between the collector of said first transistor and the base of said eighth transistor.

8. A reference power supply, supplied with power from a high-potential power supply and a low-potential power supply, comprising:

a reference voltage source for producing a constant voltage based on power from said high-potential and low-potential power supplies; and an amplifier, coupled to said reference voltage source and having an output terminal connectable to an external load for amplifying said constant voltage to produce a load-driving reference voltage at said output terminal, wherein said amplifier includes:

first and second constant current sources connected to said high-potential power supply;

a first transistor having an emitter connected to said high-potential power supply, a collector connected to said output terminal and a base connected to said second constant current source, said first transistor serving as an output transistor;

a first resistor circuit provided between the collector of said first transistor and said low-potential power supply;

a first current mirror circuit having second and third transistors, said second transistor having an emitter connected to said first resistor circuit, said third transistor having an emitter connected to said reference voltage source;

a second current mirror circuit having a fourth transistor, provided between said first constant current source and said low-potential power supply, and a fifth transistor, provided between said second transistor and said low-potential power supply; and a third current mirror circuit having a sixth transistor, provided between said third transistor and said low-potential power supply, and a seventh transistor, provided between said second constant current source and said low-potential power supply;

said amplifier further including an eighth transistor having a base connected to said second constant current source, an emitter connected to said base of said first transistor and a collector connected to said low-potential power supply, wherein said first and eighth transistors form a Darlington circuit; and a second capacitor connected between the collector of said first transistor and the emitter of said second transistor.

9. The reference power supply according to claim 1, wherein each of said first and second constant current sources is formed by a current mirror circuit comprising a pair of transistors having bases connected to a constant current circuit.

* * * * *